US009635883B1

(12) United States Patent
Guardino

(10) Patent No.: US 9,635,883 B1
(45) Date of Patent: May 2, 2017

(54) RELOADING SMOKING PIPE

(71) Applicant: Charles Guardino, Los Angeles, CA (US)

(72) Inventor: Charles Guardino, Los Angeles, CA (US)

( * ) Notice: Subject to any disclaimer, the term of this patent is extended or adjusted under 35 U.S.C. 154(b) by 0 days.

(21) Appl. No.: 15/046,768

(22) Filed: Feb. 18, 2016

(51) Int. Cl.
*A24F 1/26* (2006.01)
*A24F 3/00* (2006.01)

(52) U.S. Cl.
CPC . *A24F 1/26* (2013.01); *A24F 3/00* (2013.01)

(58) Field of Classification Search
None
See application file for complete search history.

(56) References Cited

U.S. PATENT DOCUMENTS 4,478,228 A * 10/1984 Chister ..... A24F 3/02 131/180
4,484,590 A * 11/1984 Singh ..... A24F 1/26 131/180

* cited by examiner

*Primary Examiner* — Michael J Felton
(74) *Attorney, Agent, or Firm* — Fish & Richardson P.C.

(57) ABSTRACT

A pipe is disclosed that includes a body and a smokable substance storage compartment. The body may define a hollow shaft that extends from a first end of the body to a second end of the body. The hollow shaft may terminate at a first opening in the first end of the body and at a second opening in the second end of the body. The pipe may include a reloading slide that is configured to movably engage the body and includes a reloading recess that is configured to receive a portion of a smokable substance from the smokable substance storage compartment. The reloading slide may be configured to align a reloading recess with a portion of the body that provides access to the smokable substance storage compartment or the portion of the body that defines the first opening in the first end of the body.

20 Claims, 8 Drawing Sheets

RELOADING SMOKING PIPE

BACKGROUND

People of a variety of different nations have smoked smokable substances such as tobacco for centuries. Such people have generally adhered to two different approaches to smoking smokable substances. The first approach is containing a predetermined amount of a smokable substance within a single use, disposable wrapping that will burn along with the smokable substance. The second approach is to utilize a reusable smoking device typically referred to as a pipe to smoke a smokable substance. A reusable pipe may be consistently refilled with a predetermined amount of a smokable substance which may be ignited, burned, and inhaled by a person using the pipe.

To refill the reusable pipe with a smokable substance, a person may typically need to possess a separate container of tobacco that the person would need to access in order to add an additional amount of smokable substance to the reusable pipe after each use.

SUMMARY

According to at least one aspect of the subject matter disclosed by this specification, a pipe is disclosed that includes features that may be used to automatically reload the pipe with a smokable substance. For instance, the pipe may include a reloading slide that defines a reloading recess that may be configured to receive a predetermined amount of a smokable substance from a smokable substance storage compartment. In a smoking position, the pipe may allow a pipe user to ignite the smokable substance so that the substance burns and creates a smoke that the user of the pipe can inhale. After the smokable substance has burned away, the pipe user may move the reloading slide into a reloading position that aligns at least a portion of the reloading recess with a smokable substance storage compartment. In the reloading position, a portion of the smokable substance residing within the smokable substance storage area may travel into the reloading recess. The user may move the reloading slide back to the smoking position after the smokable substance has been received by the reloading recess. The user may then proceed to use the pipe to smoke the smokable substance.

In one implementation, a pipe is disclosed that may include a pipe body. The pipe body may define a hollow shaft that extends from a first end of the pipe body to a second end of the pipe body, wherein the hollow shaft terminates at a first opening defined in the first end of the pipe body and at a second opening defined in the second end of the pipe body. The pipe body may also define a smokable substance storage compartment. The pipe may also include a reloading slide that includes a first side and a second side, wherein the first side of the reloading slide defines a reloading recess that may be configured to receive at least a portion of a smokable substance from the smokable substance storage compartment, wherein the reloading slide may be configured to movably engage the pipe body. The reloading slide may be configured to move relative to the pipe body into a reloading position, wherein the reloading position aligns at least a portion of the reloading recess with at least a portion of the body that provides access to the smokable substance storage compartment. In addition, the reloading slide may be configured to move relative to the pipe body into a smoking position, wherein the smoking position aligns at least a portion of the reloading recess with the hollow shaft.

Other versions of the corresponding subject matter disclosed by this specification may include a pipe that includes a body. The body may define a hollow shaft that extends from a first end of the body to a second end of the body, wherein the hollow shaft terminates at a first opening defined in the first end of the body and at a second opening defined in the second end of the body. The pipe may also define a smokeable substance storage compartment. The pipe may include a reloading slide that may be configured to movably engage the body and includes a reloading recess that may be configured to receive at least a portion of a smokable substance from the smokable substance storage compartment, wherein the reloading slide may be configured to align at least a portion of the reloading recess with a portion of the body that provides access to the smokable substance storage compartment or the portion of the body that defines the first opening in the first end of the body.

These and other versions each may optionally include one or more of the following features. For example, the smokeable substance received from the smokeable substance storage compartment may include tobacco. The second end of the pipe body may include a mouthpiece. In certain implementations, the second end of the pipe body may also include a removable lid that covers the smokeable substance storage compartment.

In some aspects, the hollow shaft may include a first section and a second section. In such instances, the first section may have a larger cross sectional area than the second section. In some implementations, the reloading recess may be aligned with the first section of the hollow shaft when in the smoking position.

In other implementations, the pipe body may include a latching mechanism. The latching mechanism may be a protuberance that extends from the first end of the pipe body. The reloading slide may include a first latching recess and a second latching recess, wherein the first latching recess resides between the reloading recess and the second latching recess. The protuberance may be configured to engage the first latching recess in the reloading position. Similarly, the protuberance may be configured to engage the second latching recess in the smoking position.

In yet other implementations, the pipe may be configured to prohibit the reloading recess from aligning with both the portion of the body that provides access to the smokable substance storage compartment and the portion of the body that defines the first opening in the first end of the body at the same time.

DETAILED DESCRIPTION

Figure 1A:
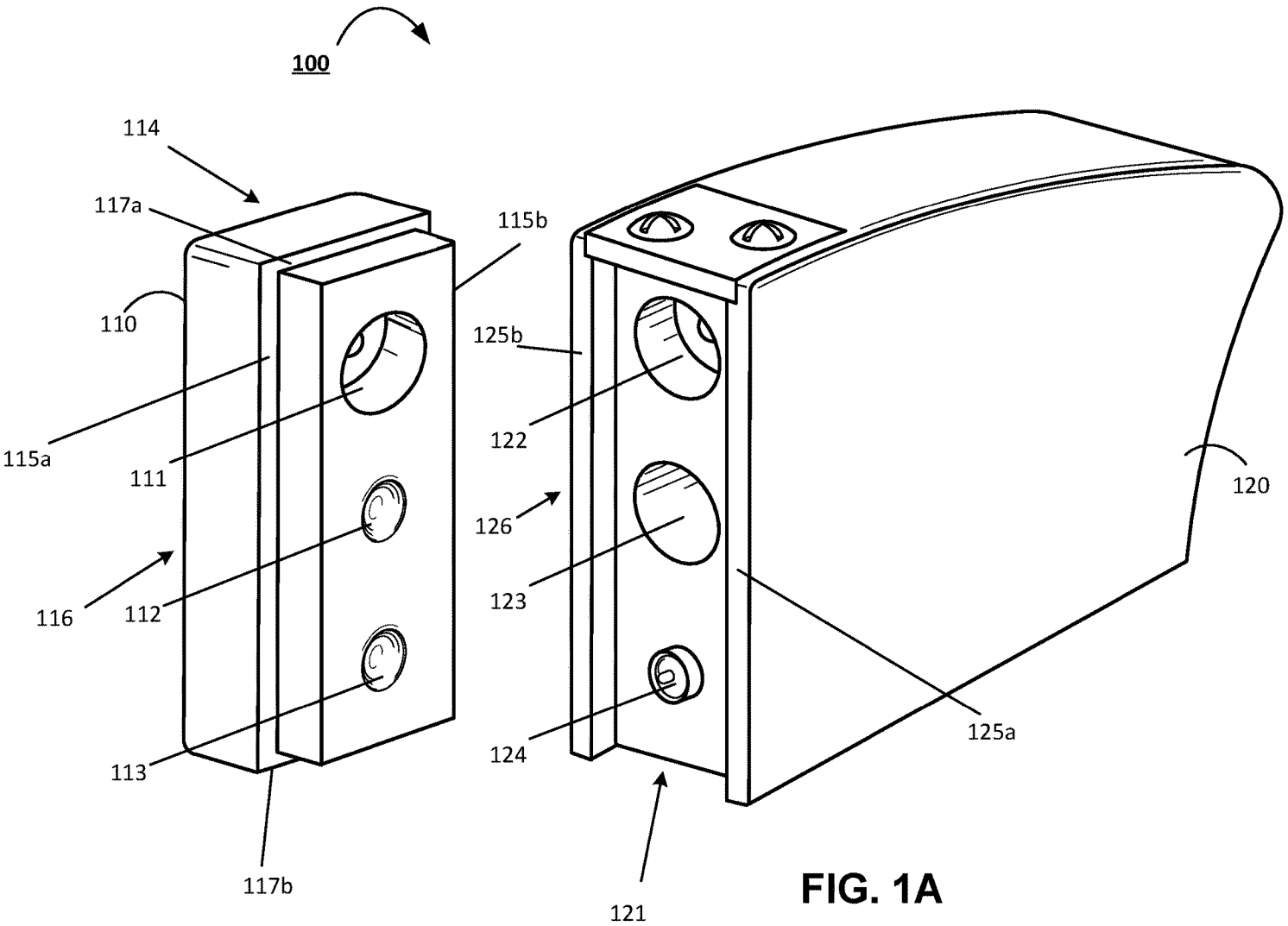
FIG. 1A illustrates an example of a pipe that may include a reloading slide and pipe body.

FIG. 1A illustrates an example of a pipe 100 that may include a reloading slide 110 and a pipe body 120.

The reloading slide 110 may include a reloading recess 111, a first latching recess 112, a second latching recess 113, a first edge 115*a*, and a second edge 115*b*. The reloading slide 110 may define a reloading recess 111. The reloading recess 111 may be configured to receive a predetermined amount of a smokable substance. In some implementations, the reloading slide 110 may be configured to movably engage the pipe body 120. For example, the end 114 of reloading slide 110 that runs perpendicular to the first edge 115*a* and the second edge 115*b* may be aligned with a portion 121 of the pipe body 120 that is configured to receive the reloading slide 110. In such instances, the first edge 115*a* and the second edge 115*b* may be configured to movably engage a first lip 125*a* and a second lip 125*b* of the pipe body 120, respectively. This engagement may facilitate a connection between the reloading slide 110 and the pipe body 120 that permits the reloading slide 110 to move back and forth along the first lip 125*a* and second lip 125*b* of the pipe body 120 without disengaging from the pipe body 120.

For instance, the first edge 115*a* and second edge 115*b* of the reloading slide 110 may each include a slot that is configured to receive the first lip 125*a* and second lip 125*b*, respectively. Each slot may function as a track for the first lip 125*a* and second lip 125*b*. Each lip 125*a*, 125*b* may be shaped such that the pipe body 120 can movably engage the slots of each edge 115*a*, 115*b* in a manner that prevents forces such as, for example, gravity from disengaging the reloading slide 110 from the pipe body 120. In one implementation, for example, each lip 125*a*, 125*b* may be, "T" shaped. However, the lips 125*a*, 125*b*, and corresponding slots, may be fashioned into any shape so long as the lips 125*a*, 125*b*, and corresponding slots, are configured to mate with each other in a manner that allows the reloading slide 110 to movable engage the pipe body 120, in the manner described herein. Alternatively, a pipe 100 may also utilize a reloading slide 110 that may include one or more lips to engage one or more corresponding slots employed by a pipe body 120.

The position of reloading recess 111 may be adjusted relative to the pipe body 120 using a reloading slide 110 that has movably engaged the pipe body 120. For instance, the reloading slide 110 may be used to adjust the reloading recess 111 in order to substantially, or partially, align the reloading recess 111 with the first opening 122 defined by the pipe body 120. Alternatively, the reloading slide 110 may be used to adjust the reloading recess 111 in order to substantially, or partially, align the reloading recess 111 with the second opening 123 defined by the pipe body 120. Though reloading slide 110 may be configured to movably engage the pipe body 120 using a first edge 115*a*, a second edge 115*b*, a first lip 125*a*, and a second lip 125*b*, there are other ways for a reloading slide 110 to movably engage the pipe body 120 that fall within the scope of the present disclosure.

For instance, the first opening 122 and the second opening 123 may be positioned such that they may be substantially horizontally to one another (as opposed to the vertical alignment of FIG. 1A). In such instances, the reloading recess 111 may be configured to align side 116 of the reloading slide 110 with a portion 126 of the pipe body 120. Under such a scenario, a reloading slide 110 may be configured to include a third edge 117*a* and a fourth edge 117*b* that may be used to movably engage one or more other lips of pipe body 120. Alternatively, for example, a portion of reloading slide 110 may be coupled to pipe body 120 using a swivel. In such instances, a reloading slide 110 may movably engage a pipe body 120 using a swivel to rotate the reloading slide 110 back and forth between the first opening 122 and second opening 123. There may be yet other ways that the reloading slide 110 may be configured to movably engage the pipe body 120 that fall within the scope of the present disclosure.

The pipe 100 may include a latching mechanism that may prevent the reloading slide 110 from being unintentionally adjusted. For instance, the position of the reloading recess 111 may be adjusted so that the reloading recess 111 may substantially, or partially, align with a second opening 123 in the pipe body 120. In such instances, the latching protuberance 124 that protrudes from the pipe body 120 may be configured to mate with the first latching recess 112. The reloading slide 110 may be held in place while the latching protuberance 124 is mated with the first latching recess 112. The reloading slide 110 may continue to be held in place by the mated latching protuberance 124 and the first latching recess 112 until a sufficient force is applied to reloading slide 110 in order to dislodge the latching protuberance 124 from the first latching recess 112. Alternatively, the position of the reloading recess 111 may be adjusted so that the reloading recess 111 may substantially, or partially, align with the first opening 122. In such instances, the latching protuberance 124 may be configured to mate with the second latching recess 113. The reloading slide 110 may be held in place while the latching protuberance 124 is mated with the second latching recess 113. The reloading slide 110 may continue to be held in place by the mated latching protuberance 124 and second latching recess 113 until a sufficient force is applied to reloading slide 110 in order to dislodge the latching protuberance 124 from the second latching recess 113.

The pipe body 120 may include a first opening 122 that defines a first end of a hollow shaft, a second opening 123 that defines an opening that may provide access to a smokable substance storage compartment, a latching protuberance 124, a first lip 125*a*, a second lip 125*b*, and a mouthpiece.

Figure 5A:
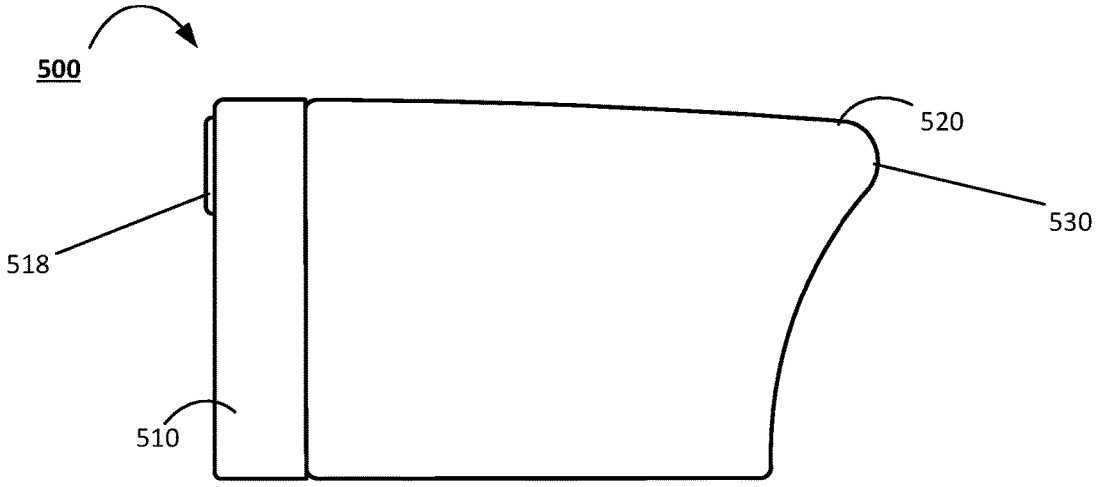
FIG. 5A is an illustration that shows a side view of a pipe in the smoking position.
Figure 5B:
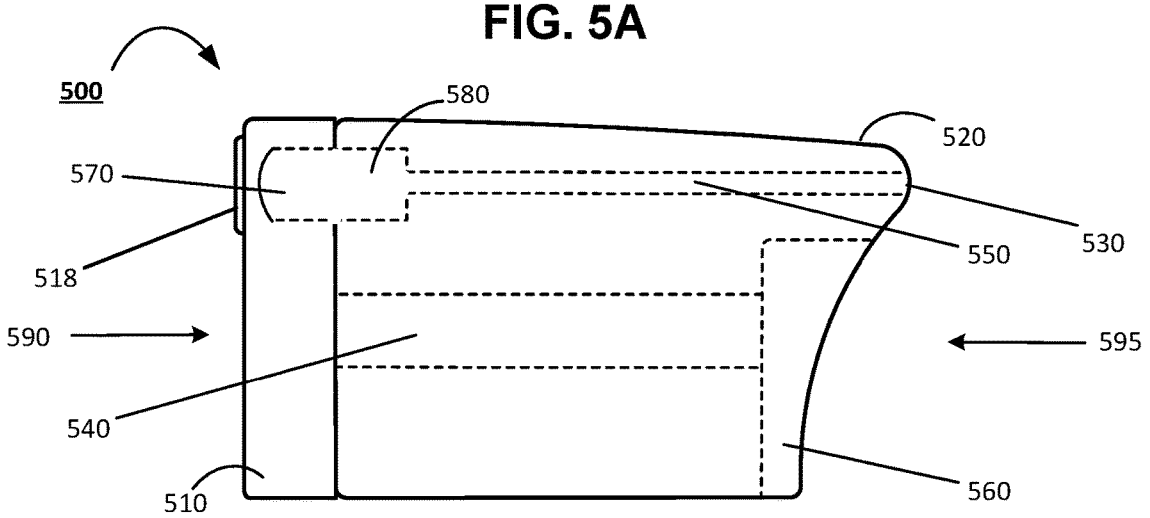
FIG. 5B illustrates a side view of an example of a pipe in the smoking position that shows additional features of the pipe.
Figure 5C:
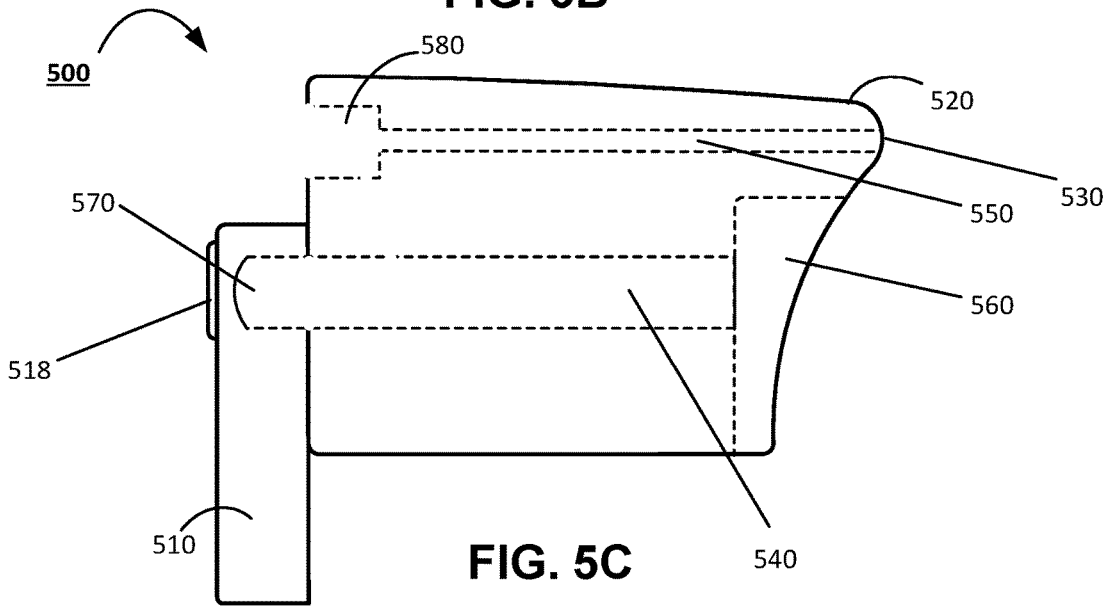
FIG. 5C illustrates a side view of an example of a pipe in the reloading position that shows additional features of the pipe.

The pipe body 120 may be configured to house a hollow air shaft and a smokable substance storage compartment, shown in more detail in FIGS. 5B and 5C. The hollow air shaft may begin at the mouthpiece associated with one end of the pipe body 120 and terminate at the first opening 122 on the other end of the pipe body 120. A person may smoke a smokable substance using the pipe 100 when the reloading recess 111 contains a smokable substance, and the reloading recess 111 is substantially, or partially, aligned with the first opening 122. In such an alignment, the person may use a flame to ignite the smokeable substance residing within the reloading recess 111. After the smokable substance has been ignited, a person may place the mouthpiece of the pipe 100 into the person's mouth and then the person can inhale the smoke that results from the burning of the smokeable substance that has been ignited. In response to the person's act of inhaling, the smoke that results in the hollow air shaft from the burning of the smokable substance may travel through the hollow air shaft and out the mouthpiece into the person's respiratory system.

The hollow air shaft may be a variety of different sizes. In some instances, the hollow air shaft may be substantially the same size the entire length of the pipe 100. Alternatively, the hollow air shaft may be associated with a first portion near the first opening 122 that may have a larger cross-sectional area than a second portion of the hollow air shaft that may include a smaller cross-sectional area. The transition in the size of the hollow shaft may function to prohibit, or otherwise reduce, the amount of ash or debris that may travel through the hollow air shaft and into a person's respiratory system in response to a person's act of inhaling.

The pipe body 120 may also include a smokable substance storage compartment for storing a predetermined amount of a smokable substance. A predetermined amount of a smokable substance may include, for example, an amount of a smokable substance that is sufficient to reload a reloading recess 111 at least once. Alternatively, a predetermined amount of a smokable substance may include, for example, an amount of a smokable substance that is sufficient to reload a reloading recess 111 multiple times. A smokeable substance may include, for example, tobacco. In one instance, the smokable substance storage compartment may be filled by removing a removable lid from a portion of the pipe body 120 to reveal another access path to the smokable substance storage compartment, as shown in FIG. 4B, and inserting a predetermined amount of a smokable substance into the smokable substance storage compartment. Alternatively, the smokable substance storage compartment may be filled with a smokable substance by inserting a predetermined amount of a smokable substance through the second opening 123.

Figure 1B:
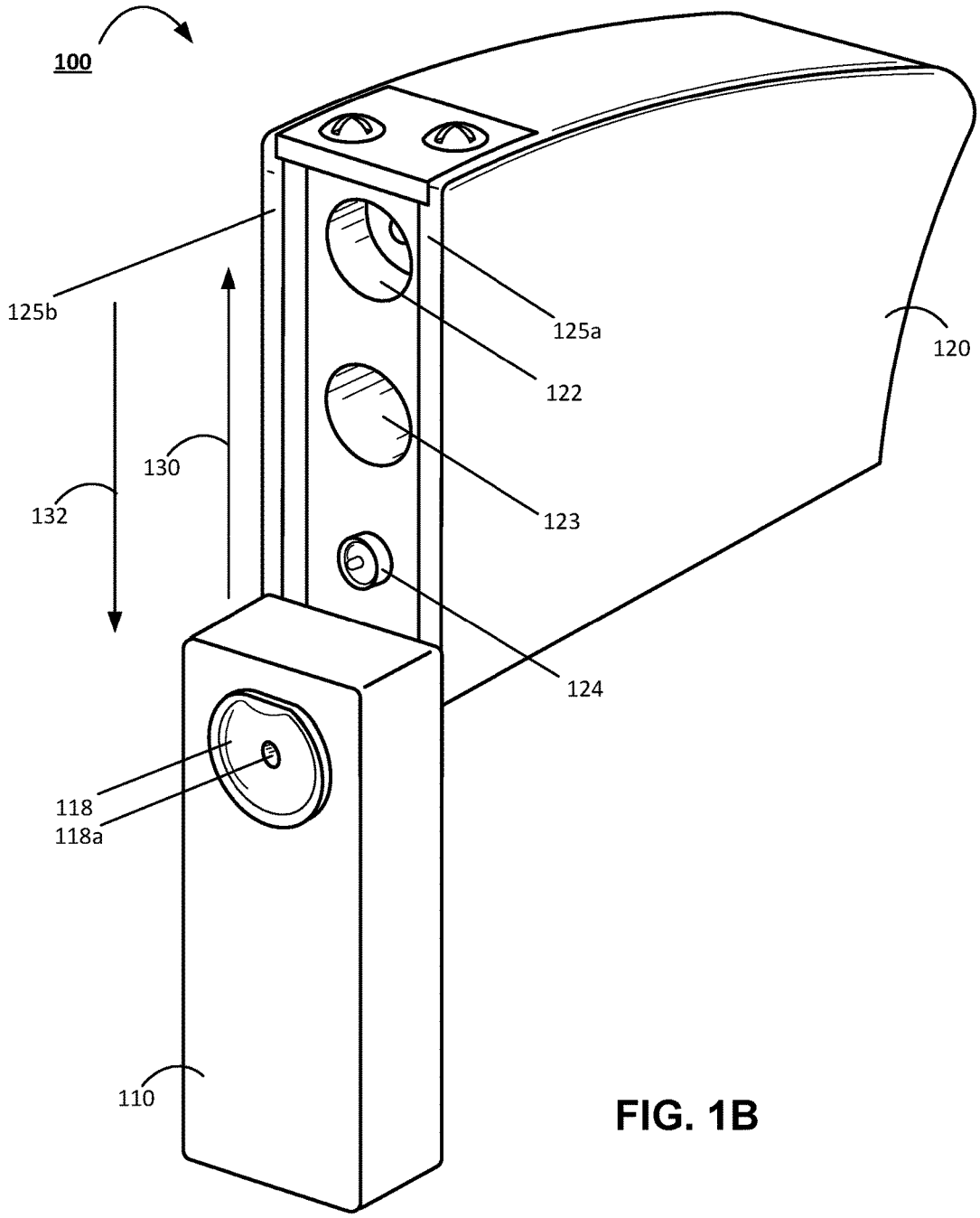
FIG. 1B illustrates an example of a pipe that may include a reloading slide that has movably engaged a pipe body.

FIG. 1B illustrates an example of the pipe 100 that may include the reloading slide 110 that has movably engaged the pipe body 220.

In one implementation, the first edge 115*a* and second edge 115*b* of reloading slide 110 may be configured to movably engage a first lip 125*a* and a second lip 125*b* of pipe body 120, respectively. Once the reloading slide 110 has been configured to movably engage the pipe body 120, the reloading slide 110 may be used to adjust the position of the reloading recess 111 relative to the pipe body 120. For instance, the reloading slide 110 can be used to move the reloading recess 111 towards 130 the first opening 122 that is defined by the pipe body 120. Alternatively, the reloading slide 110 can be used to move the reloading recess 111 away from 132 the first opening 122 that is defined by the pipe body.

The reloading slide 110 may also include an ignition plate 118. The ignition plate 118 may be a piece of metal that resides in substantially the same location as the reloading recess 111 on the opposite side of the reloading slide 110. The ignition plate 118 may function to protect the reloading slide 110 from a flame that is used to ignite the smokeable substance residing within the reloading recess 111. To ignite a predetermined amount of smokeable substance residing within the reloading recess 111, a person may move the reloading slide 110 into the smoking position, bring an ignited flame into contact with the ignition plate 118, and then inhale. When the person inhales, a sufficient amount of the flame will be brought into the reloading recess 111 through the hole 118*a* in the ignition plate 118 and ignite the smokable substance residing within the reloading recess 111. The smokable substance may then burn, and create smoke, which can be inhaled by a person using pipe 100.

Figure 1C:
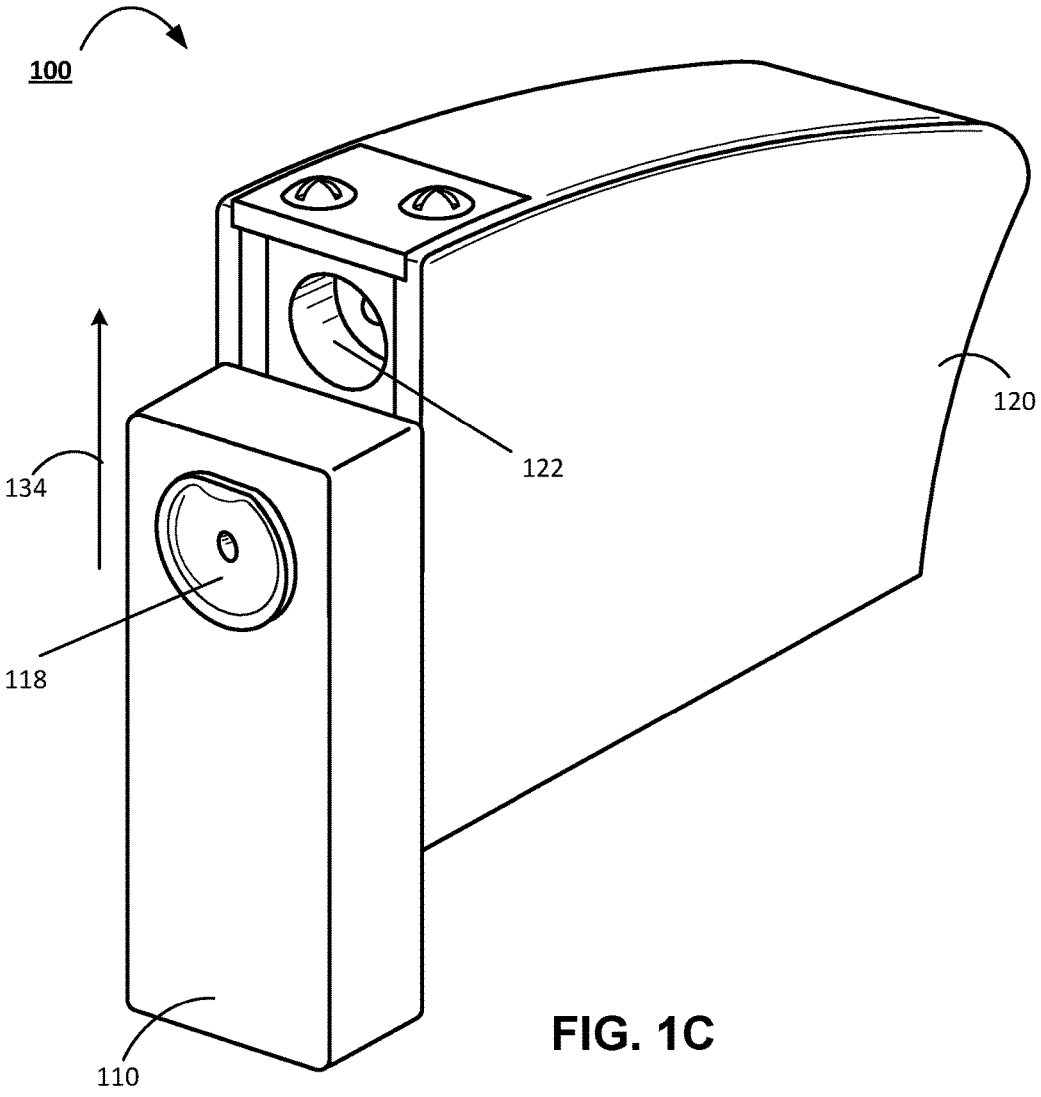
FIG. 1C illustrates an example of a pipe where the reloading slide has been used to adjust the reloading recess into a reloading position.

FIG. 1C illustrates an example of the pipe 100 where the reloading slide 110 has been used to adjust the reloading recess 111 into the reloading position.

The reloading position may be characterized by a particular alignment between the reloading recess 111 and a second opening 123 that is defined by the pipe body 120. For instance, the reloading position may be when the reloading slide 110 has been used to align 134 at least portion of the reloading recess 111 with at least a portion of the second opening 123. Alternatively, the reloading position may be when the reloading slide 110 has been used to align substantially all of the reloading recess 111 with substantially all of the second opening 123. The second opening 123 that is defined by the pipe body 120 may provide an access path to the smokable substance storage compartment that resides within the pipe body 120.

In the reloading position, at least a portion of the smokable substance residing within the smokable substance storage compartment may transfer from the smokable substance storage compartment into the reloading recess 111. In some implementations, the transfer of the smokable substance from the smokable substance storage area may be achieve using, for example, gravity. That is, at some point after the reloading slide 110 has been moved into the reloading position, the pipe 100 may be oriented in a particular way in order to use the force of gravity to pull at least a portion of the smokable substance residing within the smokable substance storage compartment into the reloading recess 111. Alternatively, at least a portion of the smokable substance residing within the smokable substance storage compartment may be transferred into the reloading recess 111 when the pipe 100 is in the reloading position in response to a person exerting a force upon the pipe 100. For instance, a person could adjust the reloading slide 110 into a reloading position, and then shake the pipe 100 in order to initiate a transfer of at least a portion of the smokable substance residing within the smokable substance storage compartment from the smokable substance storage compartment to the reloading recess 111. Other ways of effecting a transfer of at least portion of the smokable substance from the smokable substance storage compartment to the reloading recess 111 may also fall within the scope of the present disclosure. For instance, pipe body 120 may be fitted with a spring-loaded platform that may be configured to push at least a portion of the smokable substance residing within the smokable substance storage compartment from the smokable substance storage compartment into the reloading recess 111 when the reloading slide 110 is placed into the reloading position.

Figure 1D:
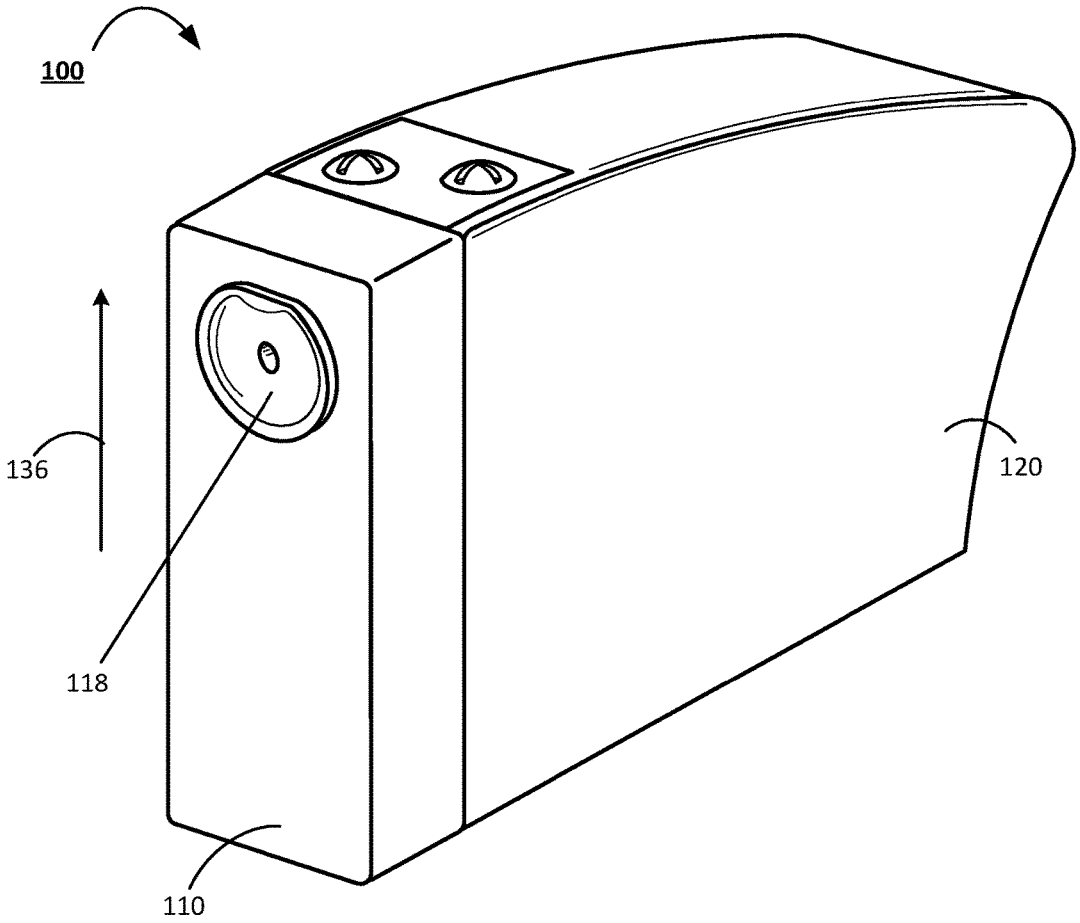
FIG. 1D illustrates an example of a pipe where the reloading slide has been used to adjust the reloading recess into a smoking position.

FIG. 1D illustrates an example of the pipe 100 where the reloading slide 110 has been used to adjust the reloading recess 111 into the smoking position.

The smoking position may be characterized by a particular alignment between the reloading recess 111 and a first opening 122 that is defined by the pipe body 120. For instance, the smoking position may be when the reloading slide 110 has been used to align 136 at least a portion of the reloading recess 111 with at least a portion of the first opening 122. Alternatively, the reloading position may be when the reloading slide 110 has been used to align substantially all of the reloading recess 111 with substantially all of the first opening 122. The first opening 122 that is defined by the pipe body 120 may be one end of the hollow air shaft that extends from the first opening 122 to the mouthpiece of the pipe.

Moving the reloading slide 110 from the reloading position (FIG. 1C) to the smoking position (FIG. 1D) may prepare the pipe 100 for smoking in those implementations where the smokable substance storage compartment has been filled with a predetermined amount of smokable substance. In such implementations, at least a portion of the smokable substance in the smokable substance storage compartment may transfer to the reloading recess 111 in the reloading position. Then, a person may move 136 the reloading slide 110 into the smoking position (FIG. 1D). This movement 136 of the reloading slide 110 loads the pipe 100 with a predetermined amount of a smokable substance. At this point, a person may ignite the smokable substance by bringing a flame into contact with ignition plate 118, and inhaling. When the person inhales, a sufficient amount of the flame will be brought into the reloading recess 111 through the hole 118*a* in the ignition plate and ignite the smokable substance residing within the reloading recess 111. The smokable substance may then burn, and create smoke, which can be inhaled by a person using pipe 100.

Figure 2A:
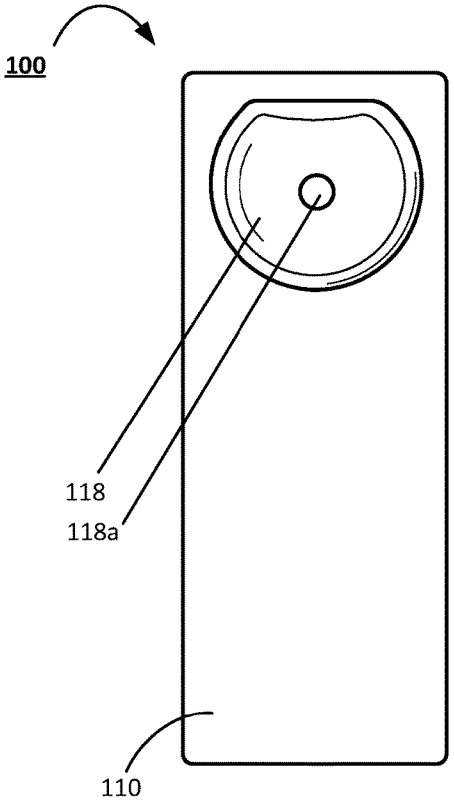
FIG. 2A illustrates another view of an end of an example of a pipe that includes a reloading slide in the smoking position.

FIG. 2A illustrates another view of an end of an example of the pipe 100 that includes the reloading slide 110 that is configured in the smoking position.

In one implementation, the reloading slide 110 may be configured to be substantially aligned with the boundaries of the pipe 100 when in the smoking position to substantially conceal the first opening 122 and hollow air shaft 210. This alignment may create a pocket that includes the space within the reloading recess 111 and first opening 122. In some instances, the pocket may include a smokable substance that has been loaded using the reloading slide 110 in accordance with processes described herein.

In the smoking position, at least a portion of the ignition plate 118, reloading recess 111, and first opening 122 may be aligned. Alternatively, in other implementations, at least the reloading recess 111 and the first opening 122 may substantially align in the smoking position. However, the pipe 100 should not be considered to be limited to such examples. For instance, any alignment, or arrangement, of the ignition plate 118, reloading recess 111, and first opening 122 may be utilized so long as the alignment, or arrangement, of the aforementioned components facilitates ignition of a smokable substance and inhalation of the smoke that follows from the ignition of the smokable substance by a person using pipe 100.

Figure 2B:
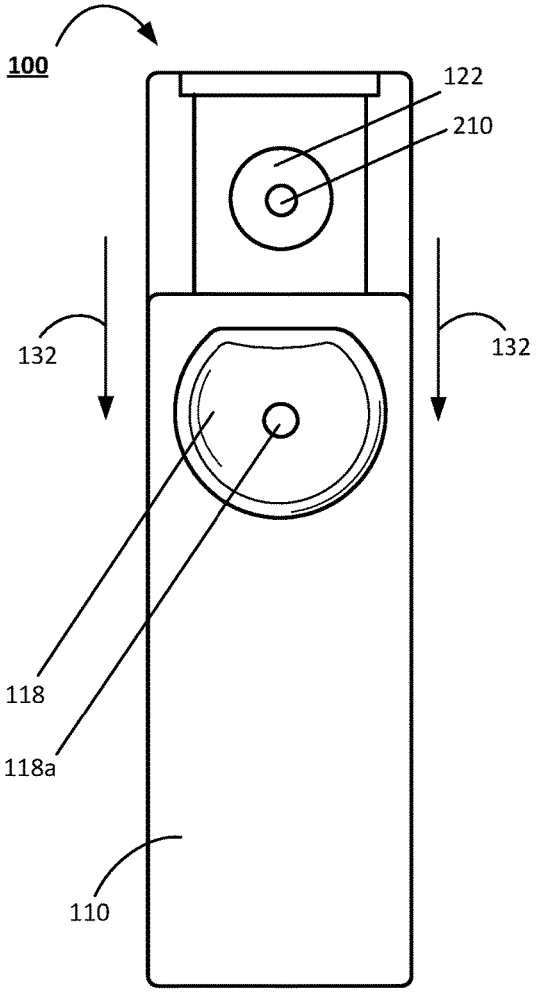
FIG. 2B illustrates another view of an end of an example of a pipe that includes a reloading slide in the reloading position.

FIG. 2B illustrates another view of an end of an example of the pipe 100 that includes the reloading slide 110 in the reloading position.

In one implementation, the reloading slide 110 may be moved 132 from the smoking position (FIG. 2A) into the reloading position (FIG. 2B). The movement 132 of the reloading slide 110 into the reloading position may expose the first opening 122 and hollow air shaft 210. Such exposure may, for example, allow for a person using pipe 100 to dispose of ash that may collect in the first opening 122. The ash may be collect in first opening 122 in response to the burning of a smokable substance.

In the reloading position, at least a portion of the ignition plate 118, reloading recess 111, and second opening 123 may be aligned. Alternatively, in other implementations, at least the reloading recess 111 and the second opening 123 may substantially align in the reloading position. However, the pipe 100 should not be considered to be limited to such examples. For instance, any alignment, or arrangement, of the ignition plate 118, reloading recess 111, and second opening 122 may be utilized so long as the alignment, or arrangement, of the aforementioned components into the reloading position facilitates transfer of a portion of a smokable substance into a reloading recess 111 from a smokable substance storage compartment.

Figure 3B:
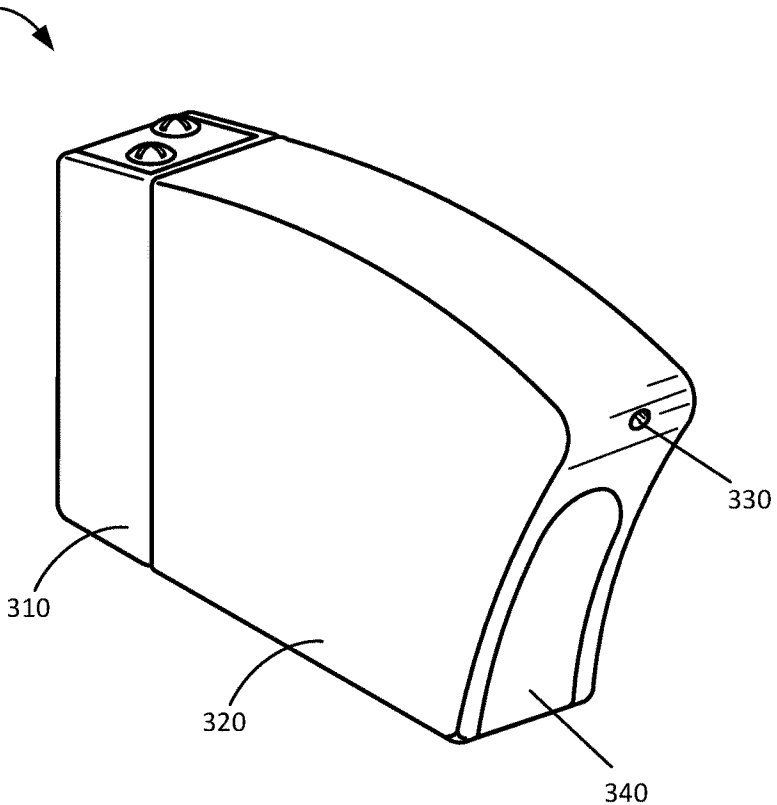
FIG. 3B illustrates another example of the pipe that may utilize a removable lid for a smokable substance storage compartment.
Figure 3A:
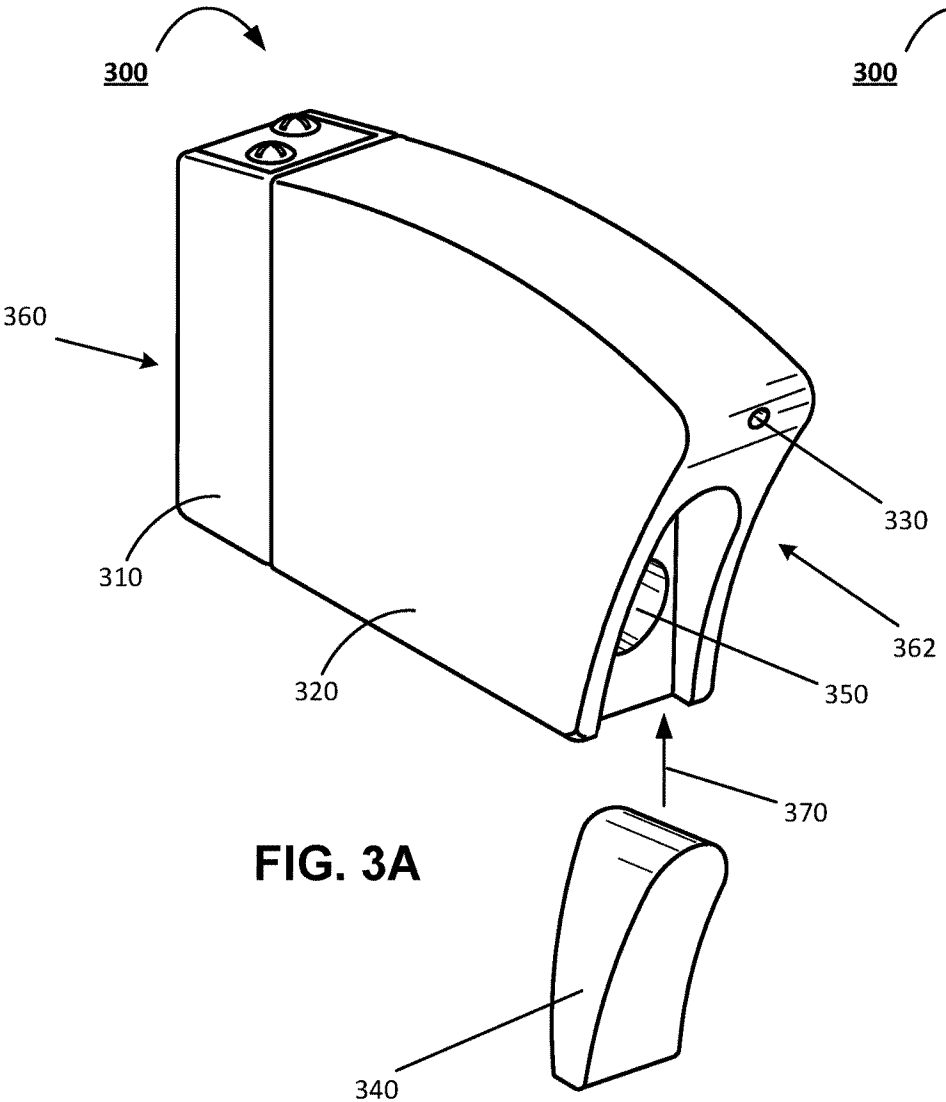
FIG. 3A illustrates an example of a pipe that may utilize a removable lid for a smokable substance storage compartment.

FIG. 3A illustrates an example of a pipe 300 that may utilize a removable lid 340 for a smokable substance storage compartment.

The pipe 300 may include, for example, a reloading slide 310, a pipe body 320, a mouthpiece 330, a removable lid 340, and an opening 350 that may provide access to a smokable substance storage compartment. The reloading slide 310 and pipe body 320 may be substantially similar to the reloading slide 110 and pipe body 120, as described above. The mouthpiece 330 may include an opening in the pipe body 320 that is associated with the end of the hollow air shaft within the pipe body 320. For instance, the hollow air shaft may terminate at the mouthpiece 330. Taken together, the hole 118*a* in the ignition plate 118, the reloading recess 111, the first opening 122, the hollow air shaft, and the mouthpiece 330, may provide an air passage way that may provide for the passage of air from a first end 360 of the pipe 300 through the second end 362 of the pipe 300. Air may pass through the pipe 300 in response to an action by a person using pipe 300. The action may include, for example, a person putting the person's mouth on the mouthpiece 330 and inhaling air through the pipe 300.

The pipe body 320 may be configured to receive a removable lid 340. The removable lid 340 may be used to reveal, or cover, an opening 350 that may provide access to the smokable substance storage compartment. For instance, the removable lid 340 may be removed so that a person may insert a predetermined amount of a smokable substance into the smokable substance storage compartment via the opening 350. Alternatively, a person may remove the removable lid 340 in order to inspect the contents of a smokable substance storage compartment to determine the amount of a smokable substance that currently resides within the smokable substance storage compartment. Alternatively, a person may remove the removable lid 340 and rotate the pipe 300 in order to remove the smokable substance that currently resides within the smokable substance storage compartment. A person may be able to cover the opening 350 that provides access to the smokable substance storage compartment by moving 370 the removable lid 340 into the portion of the pipe body 320 that is configured to receive the removable lid 340.

FIG. 3B illustrates another example of the pipe 300 that may utilize a removable lid 340 for a smokable substance storage compartment.

In the example of pipe 300 of FIG. 3B, the removable lid 340 has been moved into the portion of the pipe body 320 that is configured to receive the removable lid 340. The removable lid 340 may be held into place using a latching mechanism. For instance, the pipe body 320 may utilize a protrusion that protrudes from a portion of the pipe body 320 and is configured to mate with a recess that may be defined by the removable lid 340 when the removable lid 340 is inserted into the portion of the pipe body 320 that is configured to receive the removable lid 340. However, other latching mechanisms may be used by the pipe 300 in order to hold the removable lid 340 in place until a person decides to remove the removable lid 340.

Figure 4A:
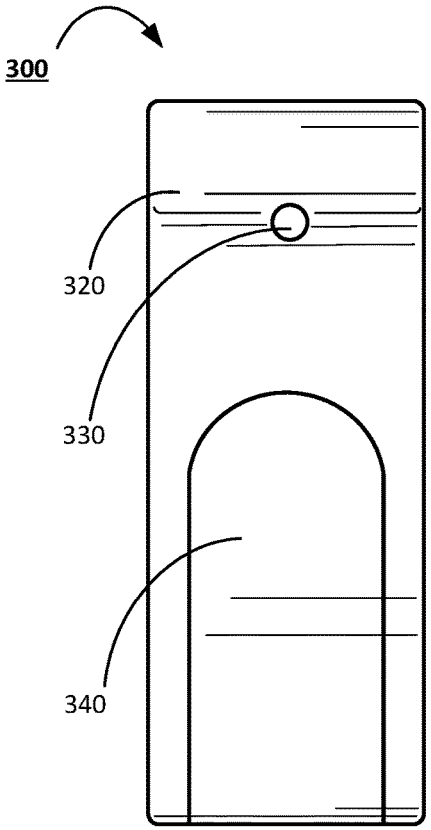
FIG. 4A illustrates another view of an end of an example of a pipe that includes a removable lid to cover a smokable substance storage compartment.
Figure 4B:
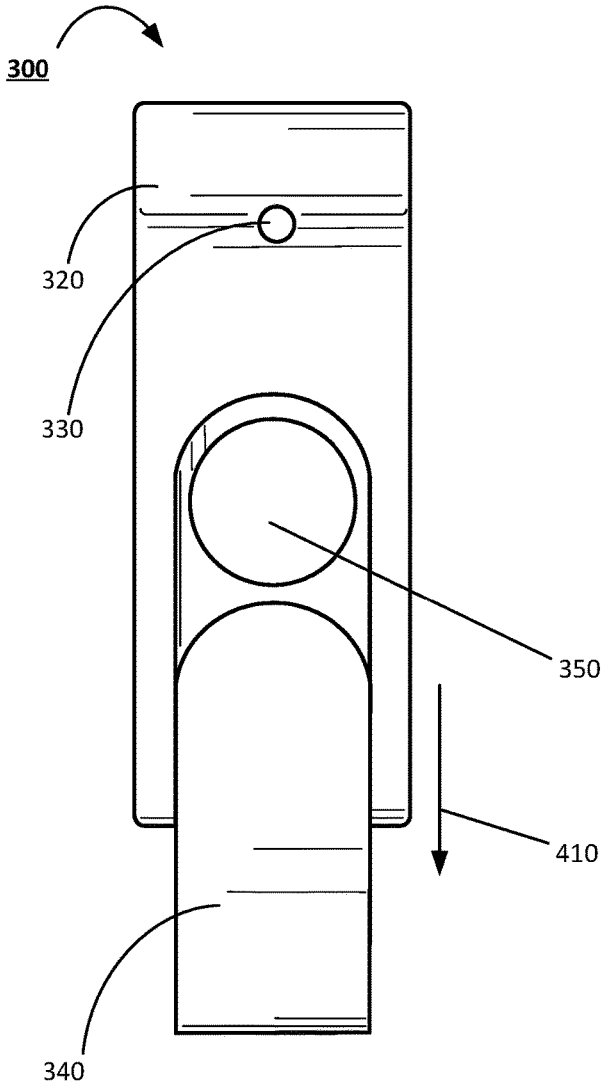
FIG. 4B illustrates another view of an end of an example of a pipe that shows an example of a smokable substance storage compartment after a removable lid covering the smokable substance storage compartment has been removed.

FIG. 4A illustrates another view of an end of an example of a pipe 300 that may include a removable lid 340 for a smokable substance storage compartment.

The end of the pipe 300 shown in FIG. 4A illustrates other features of the pipe body 320, mouthpiece 330, and removable lid 340. In the example of FIG. 4A, the removable pipe lid 340 is inserted into the portion of the pipe body 320 that is configured to receive a removable lid 340. Such a configuration of removable lid 340 may cover the opening 350 to the smokable substance storage compartment. Using the removable lid 340 to cover the opening 350 to the smokable substance storage compartment may be particularly useful to prevent loss of a smokable substance when a person is not using the pipe 300 to smoke a smokable substance. For instance, a person may insert a predetermined amount of a smokable substance into a smokable substance storage compartment, move 370 the removable lid into the position depicted by FIG. 4A, and then place the pipe 300 into the person's pocket until the person decides to use the pipe 300 to smoke at least a portion of the smokable substance that is stored in the smokable substance storage compartment. Accordingly, the removable lid 340 may prevent the unintentional removal of the contents of the smokable substance storage compartment.

FIG. 4B illustrates another example of the end of the pipe 300 that may utilize a removable lid 340 for a smokable substance storage compartment.

In the example of pipe 300 of FIG. 4B, the removable lid 340 may be moved 410 away from the portion of the pipe body 320 that is configured to receive the removable lid 340. The removable lid 340 may be moved 410 in response to a force that is exerted upon the removable lid 410. The force exerted upon the removable lid 410 may be sufficient enough to overcome the resistance employed by the latching mechanism that is used to hold the removable lid 340 in place when the removable lid 340 is inserted into the portion of the pipe body 320 that is configured to receive the removable lid 340. The opening 350 may be revealed when the removable lid 340 is moved 410 away from the portion of the pipe body 320 that is configured to receive the removable lid 340. A person may fill a smokable substance storage compartment with a smokable substance by inserting a predetermined amount of a smokable substance into the smokable substance storage compartment through the opening 350.

FIG. 5A is an illustration that shows a side view of a pipe 500 in the smoking position. The pipe 500 may include a reloading slide 510, an ignition plate 518, a pipe body 520, and a mouthpiece 530. The pipe 500 may be substantially similar to the pipes 100 and 300 described herein. Accordingly, pipe 500 may function in substantially the same manner as pipes 100 and 300.

FIG. 5B illustrates a side view of an example of the pipe 500 in the smoking position that shows additional features of the pipe 500.

The additional features of the pipe 500 may include a smokable substance storage compartment 540, a hollow air shaft 550, a removable lid 560, a reloading recess 570, and a first opening 580. The smokable substance storage compartment 540 may be a substantially hollow space that exists within the pipe 500 to store a smokable substance. The smokable substance may have at least one opening that provides an access path to the smokable substance storage compartment that may be utilized to fill the smokable substance storage compartment 540 with a smokable substance. In some implementations, the smokable substance storage compartment may have two or more openings that may each provide an access path to the smokable substance storage compartment.

The hollow air shaft 550 may provide an air flow path from a first end 590 of the pipe 500 to a second end 595 of the pipe 500. The hollow air shaft 550 may extend from the mouthpiece 530 to the first opening 580 that may be defined by the pipe body 520. In some implementations, the hollow air shaft 550 may be substantially straight. However, the present disclosure should not be so limited. For example, other implementations may include a hollow air shaft that may be curved. Alternatively, the hollow air shaft 550 may comprise multiple portions that are angled in different ways, in different portions of the pipe along the path from a first end 590 of the pipe 500 to the second end 595 of the pipe 500. As such, the hollow air shaft 550 may be arranged in any path, so long as the path established by the hollow air shaft 550 facilitates airflow from a first end 590 of the pipe 500 to the second end 595 of the pipe 500. In some instances, the hollow air shaft 550 may be hollow space that has been created by burrowing a path, tunnel, or other opening into the pipe body 520. Alternatively, the hollow air shaft 550 may also include a metal lining that provides a pipe-like path from a first end 590 of the pipe 500 to the second end 595 of the pipe 500.

In FIG. 5B, the pipe 500 is illustrated in the smoking position. The smoking position may substantially, or partially, align the reloading recess 570 with the first opening 580. The smoking position may also ensure that no portion of the reloading recess 570 aligns with any opening that provides access to the smokable substance storage compartment 540. Accordingly, in some implementations, at least a portion of the reloading recess 570 may align with the first opening 580 or at least a portion of the reloading recess 570 may align with an opening associated with a smokable substance storage compartment 540. Furthermore, in such implementations, the reloading recess 570 cannot align with both the first opening 580 and an opening that is associated with a smokable substance storage compartment 540 at the same time.

The removable lid 560 may be associated with substantially the same features as the removable lid 340 described with reference to FIGS. 3A, 3B, 4A, and 4B hereinabove.

FIG. 5C illustrates a side view of an example of a pipe 500 in the reloading position that shows additional features of the pipe 500.

In FIG. 5C, the pipe 500 is illustrated in the reloading position. The reloading position may substantially, or partially, align the reloading recess 570 with an opening of the smokable substance storage compartment 540. Once the reloading recess 570 is substantially, or partially, aligned with the smokable substance storage compartment 540, the pipe 500 may effect the transfer of at least portion of the smokable substance that resides within the smokable substance storage compartment 540 to the reloading recess 570. The transfer of the smokable substance from the smokable substance storage compartment 540 to the reloading recess 570 may be effected using one or more of the methods described hereinabove.

The reloading position depicted in FIG. 5C may also reveal the first opening 580. The revealing of the first opening 580 may facilitate the removal of ash and/or debris that builds up in the first opening 580 from the burning of a smokable substance during the process of using the pipe 500 to smoke a smokable substance. Accordingly, once the ash and/or debris is removed from the first opening 580, and the reloading recess 570 has received a portion of the smokable substance from the smokable substance storage compartment 540, the reloading slide 510 may be moved back to the smoking position of FIG. 5B in order to use the pipe 500 to smoke the reloaded smokable substance.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Thus, though particular embodiments of the subject matter have been described. These, and other embodiments, may fall within the scope of the following claims.

What is claimed is:

1. A pipe comprising:

a pipe body that defines:

a hollow shaft that extends from a first end of the pipe body to a second end of the pipe body, wherein the hollow shaft terminates at a first opening defined in the first end of the pipe body and at a second opening defined in the second end of the pipe body, and a smokable substance storage compartment that has a uniform cross-sectional area that extends from the first end of the pipe body to the second end of the pipe body; and a reloading slide that includes a first side and a second side, wherein the first side of the reloading slide defines a reloading recess that is configured to receive at least a portion a smokable substance from the smokable substance storage compartment, wherein the reloading slide is configured to movably engage the pipe body, wherein the reloading slide is configured to move relative to the pipe body into a reloading position, wherein the reloading position aligns at least a portion of the reloading recess with at least a portion of the body that provides access to the smokable substance storage compartment, and wherein the reloading slide is configured to move relative to the pipe body into a smoking position, wherein the smoking position aligns at least a portion of the reloading recess with the hollow shaft.

2. The pipe of claim 1, wherein the smokable substance is tobacco.

3. The pipe of claim 1, wherein the second end of the pipe body includes a mouthpiece.

4. The pipe of claim 1, wherein the second end of the pipe body includes a removable lid that covers the smokable substance storage compartment.

5. The pipe of claim 1, wherein the hollow shaft comprises a first section and a second section, wherein the first section has a larger cross sectional area than the second section, wherein, in the smoking position, the reloading recess is aligned with the first section of the hollow shaft.

6. The pipe of claim 1, wherein the pipe body includes a latching mechanism.

7. The pipe of claim 6, wherein the latching mechanism is a protuberance that extends from the first end of the pipe body.

8. The pipe of claim 7, wherein the reloading slide includes a first latching recess and a second latching recess, wherein the first latching recess resides between the reloading recess and the second latching recess.

9. The pipe of claim 8, wherein the protuberance engages the first latching recess in the reloading position.

10. The pipe of claim 8, wherein the protuberance engages the second latching recess in the smoking position.

11. A pipe comprising:

a body that defines:

a hollow shaft that extends from a first end of the body to a second end of the body, wherein the hollow shaft terminates at a first opening defined in the first end of the body and at a second opening defined in the second end of the body, and a smokable substance storage compartment that has a uniform cross-sectional area that extends from the first end of the pipe body to the second end of the pipe body; and a reloading slide that is configured to movably engage the body and includes a reloading recess that is configured to receive at least a portion of a smokable substance from the smokable substance storage compartment, wherein the reloading slide is configured to align at least a portion of the reloading recess with a portion of the body that provides access to the smokable substance storage compartment or the portion of the body that defines the first opening in the first end of the body.

12. The pipe of claim 11, wherein the pipe is configured to prohibit the reloading recess from aligning with both the portion of the body that provides access to the smokable substance storage compartment and the portion of the body that defines the first opening in the first end of the body at the same time.

13. The pipe of claim 11, wherein the smokable substance is tobacco.

14. The pipe of claim 11, wherein the second end of the body includes a mouthpiece.

15. The pipe of claim 11, wherein the body includes a removable lid that provides access to the smokable substance storage compartment.

16. The pipe of claim 11, wherein the body includes a latching mechanism.

17. The pipe of claim 16, wherein the latching mechanism is a protuberance that extends from the body.

18. The pipe of claim 17, wherein the reloading slide includes a first latching recess and a second latching recess, wherein the first latching recess resides between the reloading recess and the second latching recess, and wherein the protuberance engages the first latching recess when at least a portion of the reloading recess is aligned with the portion of the body that provides access to the smokable substance storage compartment.

19. The pipe of claim 17, wherein the reloading slide includes a first latching recess and a second latching recess, wherein the first latching recess resides between the reloading recess and the second latching recess, wherein the protuberance engages the second latching recess when at least a portion of the reloading recess is aligned with the portion of the body that defines the first opening in the first end of the body.

20. The pipe of claim 11, wherein the hollow shaft comprises a first section and a second section, wherein the first section has a larger cross sectional area than the second section, wherein the reloading recess is configured to align with the first section of the hollow shaft in a smoking position.

* * * * *